US009598268B2

(12) United States Patent
Larsen

(10) Patent No.: US 9,598,268 B2
(45) Date of Patent: Mar. 21, 2017

(54) BOOM TRUCK WITH SPLAYED FORWARD FRONT STABILIZERS

(75) Inventor: Herbert Larsen, Cedar Falls, IA (US)

(73) Assignee: Terex USA, LLC, Westport, CT (US)

( * ) Notice: Subject to any disclaimer, the term of this patent is extended or adjusted under 35 U.S.C. 154(b) by 830 days.

(21) Appl. No.: 13/306,638

(22) Filed: Nov. 29, 2011

(65) Prior Publication Data

US 2012/0132606 A1 May 31, 2012

Related U.S. Application Data

(60) Provisional application No. 61/418,039, filed on Nov. 30, 2010.

(51) Int. Cl.
*B66C 23/78* (2006.01)

(52) U.S. Cl.
CPC ..... *B66C 23/78* (2013.01); *Y10T 29/49826* (2015.01)

(58) Field of Classification Search
CPC ... B66C 23/78; B66C 23/80; B66C 2700/035; B66C 2700/0378
USPC ..... 212/291, 294, 299, 301–306, 343–345; 414/560, 561, 563; 280/763.1, 764.1, 280/765.1, 766.1
See application file for complete search history.

(56) References Cited

U.S. PATENT DOCUMENTS 3,144,138 A * 8/1964 Brown ..... B60S 9/10 212/304
3,326,390 A * 6/1967 Hackenberger ..... 212/231
3,650,421 A * 3/1972 Miller ..... B60P 1/5433 212/231
5,706,960 A 1/1998 Pitman et al.
6,351,696 B1 * 2/2002 Krasny et al. ..... 701/50
6,773,033 B1 * 8/2004 Fugel ..... 280/763.1
7,594,679 B1 9/2009 Schneider
2003/0168421 A1 * 9/2003 Davis ..... B66C 23/72 212/302
2007/0132277 A1 * 6/2007 Ishii et al. ..... 296/190.01

FOREIGN PATENT DOCUMENTS

DE 3122725 A1 * 12/1982 ..... F16M 7/00
DE 3124029 A1 * 3/1983 ..... F16M 11/42
EP 1178006 A1 * 2/2002 ..... B66C 23/78

OTHER PUBLICATIONS

Machine Translation of DE-3122725 A1.*

* cited by examiner

*Primary Examiner* — Sang Kim
*Assistant Examiner* — Juan Campos, Jr.
(74) *Attorney, Agent, or Firm* — Simmons Perrine Moyer Bergman PLC

(57) ABSTRACT

A boom truck with splayed forward stabilizers which permits loads to be lifted over the front of the vehicle without a central front jack and further having a pair of rear stabilizers which are separated from the splayed forward stabilizers along a substantial length of and near the rear end of the vehicle frame. The boom truck being made in a process where the attachment of the rear stabilizers is done in a separate and distinct process from the attachment of the splayed forward stabilizers.

15 Claims, 5 Drawing Sheets

BOOM TRUCK WITH SPLAYED FORWARD FRONT STABILIZERS

BACKGROUND OF THE INVENTION

This invention relates to boom trucks. Here boom trucks are referred to as motor vehicles licensed to operate on the public roads which typically are based upon a commercial truck chassis (manufactured by a truck manufacturer and available for a large variety of uses such as flat bed trucks, dump trucks, moving van trucks, etc.) and a boom truck crane structure (manufactured by a crane manufacturer) and attached to the commercial truck chassis. The present invention relates more specifically to boom trucks with front stabilizers which are splayed forward, such that they extend forward and outward when deployed from a position behind the cab of the boom truck. U.S. Pat. No. 5,706,960 to Pitman et al. shows a boom truck with an X shaped stabilizer pattern.

The X shaped stabilizer pattern has the stabilizers mounted on a heavy sub-base support structure which is itself mounted to the frame of a commercial truck chassis. This heavy sub-base structure adds substantial weight to the boom truck crane structure. This additional weight results in higher manufacturing costs for the boom truck crane structure, a higher center of gravity (which is particularly important when being driven on a roadway) it also reduces the extent of the ability of the final vehicle to carry commercial loads.

Consequently, there is a need for improvement in boom truck stability.

SUMMARY OF THE INVENTION

More specifically, an object of the invention is to provide a cost effective boom truck crane system.

It is a feature of the present invention to include front stabilizers and rear stabilizers mounted to a frame of a commercial truck chassis with a less massive sub-base structure (which is designed to greatly bolster the truck frame of the commercial truck). For example, it provides support and inter-connects the four stabilizers.

It is an advantage of the present invention to increase load carrying capacity of the boom truck.

It is also an advantage of the present invention to provide improved stability and capacity for lifting over the rear of the vehicle.

It is another object of the present invention to increase cargo carrying functionality.

It is another feature of the present invention to only include the splayed forward front stabilizers in front of the cargo bed.

It is another advantage of the present invention to provide a large uninterrupted cargo bed.

The present invention includes the above-described features and achieves the aforementioned objects.

Accordingly, the present invention comprises a boom truck with a splayed forward stabilizer set disposed at least partially above the cargo deck top height and a set of rear stabilizers displaced longitudinally therefrom and at a point substantially below the cargo deck top height.

BRIEF DESCRIPTION OF THE DRAWINGS

In the following description of the drawings, in which like reference numerals are employed to indicate like parts in the various views.

DETAILED DESCRIPTION OF THE DRAWINGS

Figure 1:
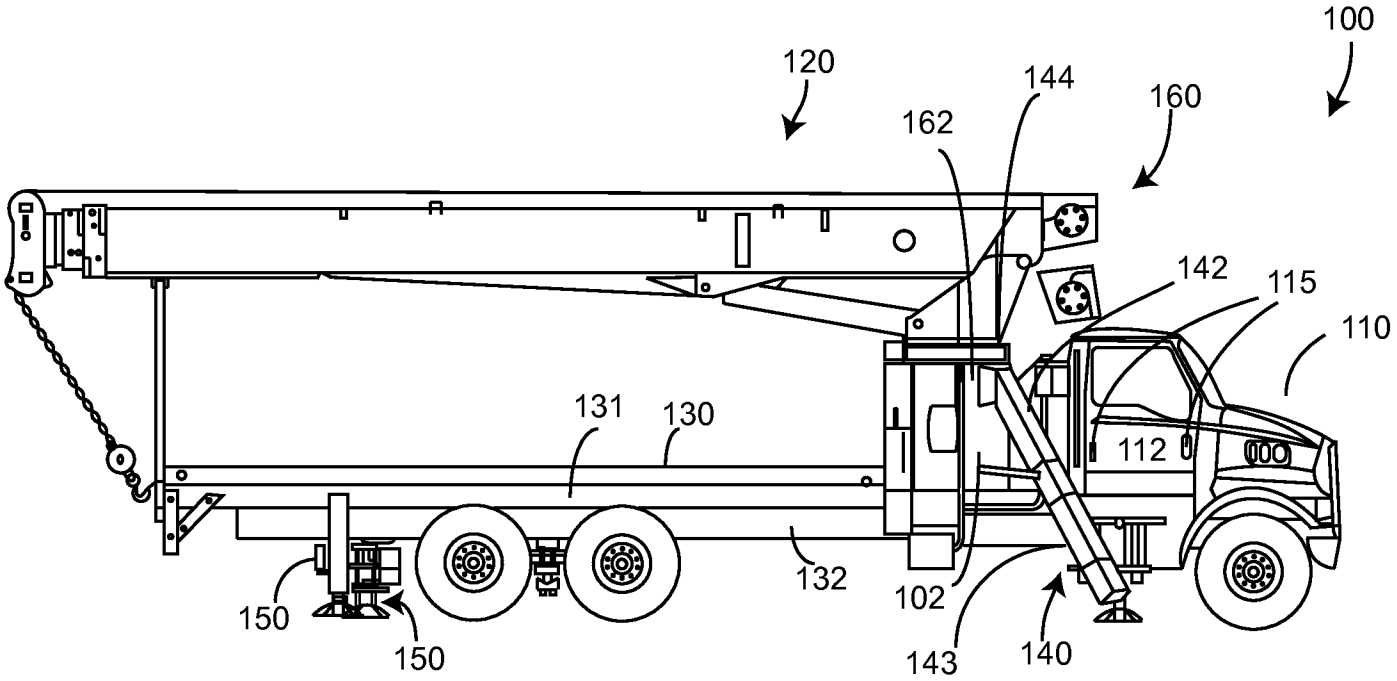
FIG. 1 is a side view of the splayed stabilized boom truck of the present invention.
Figure 4:
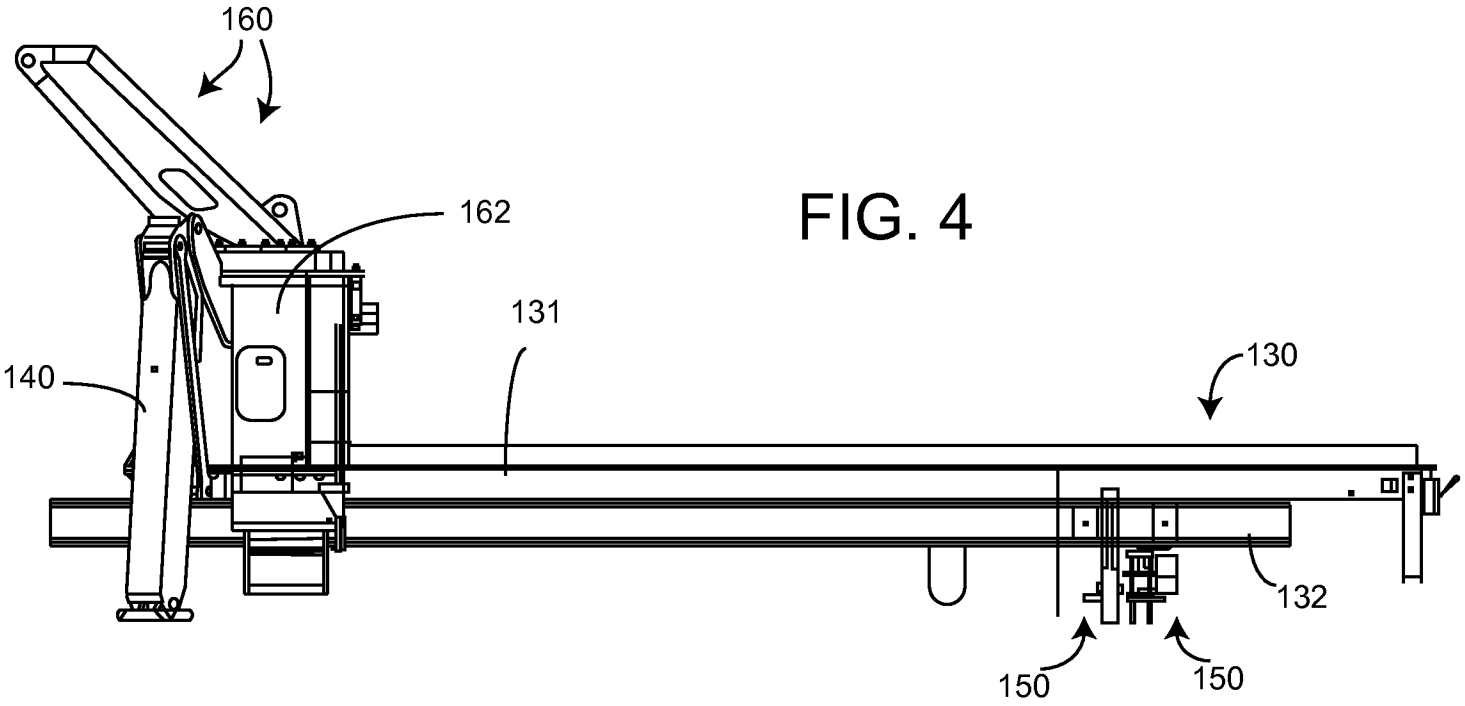
FIG. 4 shows a side view of the splayed stabilized boom truck including the connection between the rear stabilizers 150 and the commercial truck frame 132.

Referring now to the drawings, where like numerals refer to like matter throughout, and more particularly to FIG. 1, there is shown a splayed stabilized boom truck 100 with a commercial truck cab 110 with accompanying chassis. Commercial truck cab 110 may include two forward facing seats 113 and 114 and cab doors 112 with optional dual door handles 115 which could be forward hinged or rear hinged doors or can be doors which selectively open in either direction. Attached to the chassis is commercial load carrying flat cargo bed 130 and subframe 131 which together are coupled to commercial truck frame rails 132 (considered part of the commercial chassis). Subframe 131 is preferably more substantial and stronger than a subframe that would typically be used with stabilizers which are not splayed forward, i.e.; at 90 degrees with respect to the frame rails 132. Subframe 132 is essentially an enclosed box with cross bracing therein, which is first mounted to the frame rails 132 and then which receives thereon the main frame 162 and the deck 130. The deck 130, the subframe 131 and the frame rails 132 may be liberally through bolted together to ideally create a structure which behaves much like a single structure which has substantially more twisting stiffness than would the frames rails 132 alone. Front stabilizers 140 are shown in FIG. 4 coupled to ears 144 of main frame 162 and via a link 145 to a connection on the subframe 131. (Note: that a link is shown in FIG. 1 which is coupled to an alternate location on the main frame 162 and the front stabilizer 140).

The splayed stabilized boom truck 100 includes a boom 120 which is coupled through boom rotating turret 160. The splayed stabilized boom truck 100 is stabilized by splayed forward front stabilizer system 140 and rear stabilizers 150. Splayed forward front stabilizer system 140 includes a front stabilizer upper portion 142 which is coupled to the main frame/turret elevating structure 162 by angled front stabilizer mating connection/ears 144 and also coupled to front stabilizer lower portion 143. Angled front stabilizer mating connections/ears 144 may be welded or otherwise attached to the main frame 162 with sufficient strength to withstand substantial bending and twisting forces thereon. It may be preferred that the ears 144 are more substantial and stronger than would normally be thought to be necessary if the front stabilizers 140 were not splayed forward. The angle of ears 144 determines the splayed forward angle of the stabilizers 140.

Front stabilizer upper portion 142 and front stabilizer lower portion 143 may be telescopic, folding or otherwise configured to allow for the splayed forward front stabilizer system 140 to extend further away from the splayed stabilized boom truck 100. Angled front stabilizer mating connection 144 defines the amount of the angle that the splayed forward front stabilizer system 140 is splayed in the forward direction. With 0 degrees being taken as extending orthogonal to the longitudinal axis of the truck frame and 90 degrees being extending directly forward (in front of the truck) the angle of forward splay may be determined based upon particular design criteria for a particular boom truck application. The angle of forward splay must be substantially greater than 0 degrees or very little benefit would be achieved with the forward splay. In some applications a forward splay of between 15 degrees and 45 degrees may be ideal, in certain other applications a forward splay of around 27 degrees might be preferred. Use of rear hinged doors for cab door 112 may facilitate even larger splay angles while still permitting ingress and egress from the splayed stabilized boom truck 100 when the splayed forward front stabilizer system 140 is deployed.

Rear stabilizers 150 and splayed forward front stabilizer system 140 are not coupled to the commercial truck frame 132 as a single unit. The only common structural supporting elements common to splayed forward front stabilizer system 140 and rear stabilizers 150 are the commercial truck frame 132 and the sub-frame 131 (FIGS. 1, 4 and 5) which is relatively less massive than some prior art sub-frames used to support an X stabilizer configuration. Note: The rear stabilizers 150 are preferably not indirectly coupled to the frame 132 via a load bearing connection with the sub-frame 131. This reduction of the heavy crane structure sub-base (similar to the massive full load bearing sub-frames found in some prior art systems) allows for increased payload for the present invention. For example, if the splayed stabilized boom truck 100 were being used as a vehicle to off load pallets of bricks at a construction site, the increased payload can provide substantial economic benefits.

Figure 2:
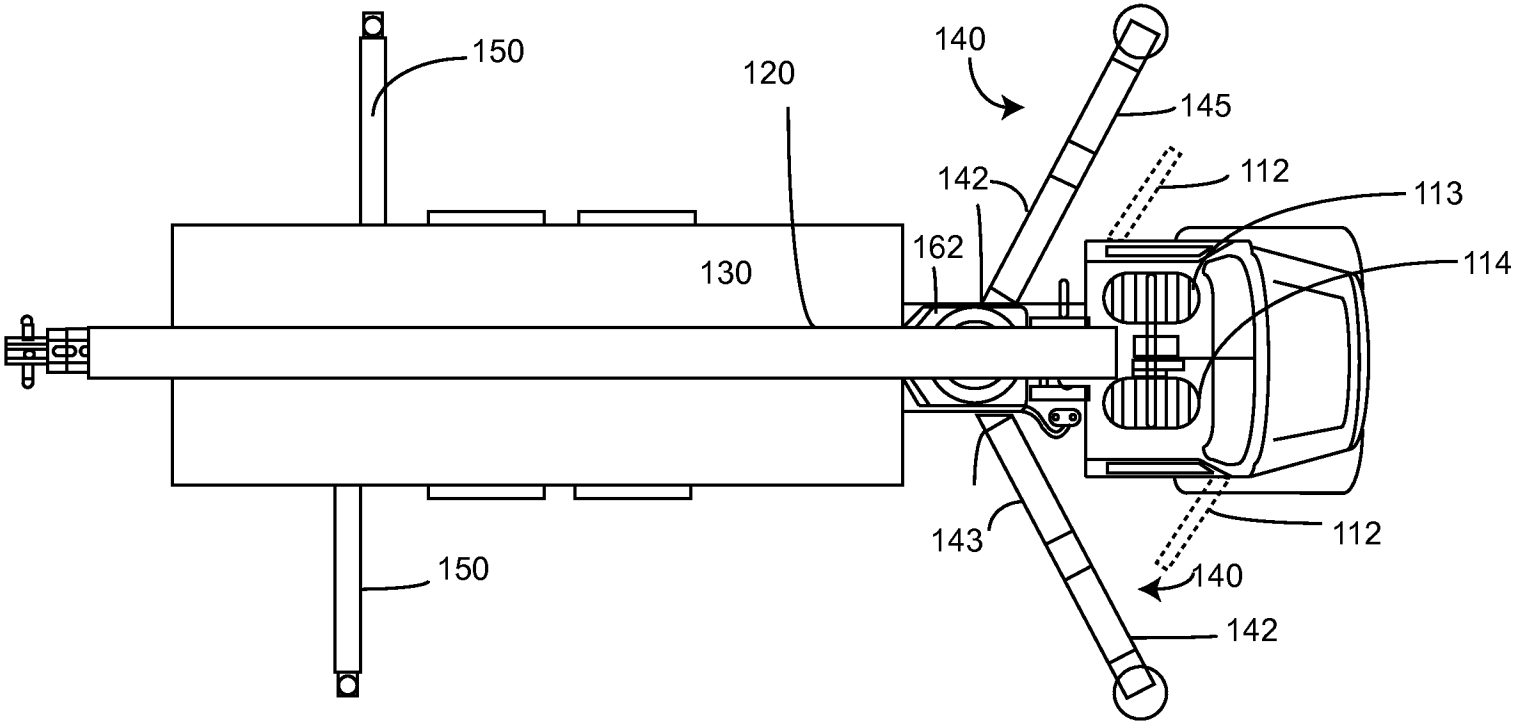
FIG. 2 is a plan view of the splayed stabilized boom truck of FIG. 1 where the dotted lines show at least one of the phantom positions of each of the doors in an open configuration.

Now referring to FIG. 2, there is shown a splayed stabilized boom truck 100 of FIG. 1 where the forward splay angle is clearly shown to be 27 degrees. It can be readily seen that the rear stabilizers 150 are not co-linear. They are staggered so as to permit further retraction of a rear stabilizer to extend beyond the midway point of the vehicle. The dotted lines show phantom door positions which demonstrate that the doors can be mounted to swing forward or swing backward or both.

Figure 3:
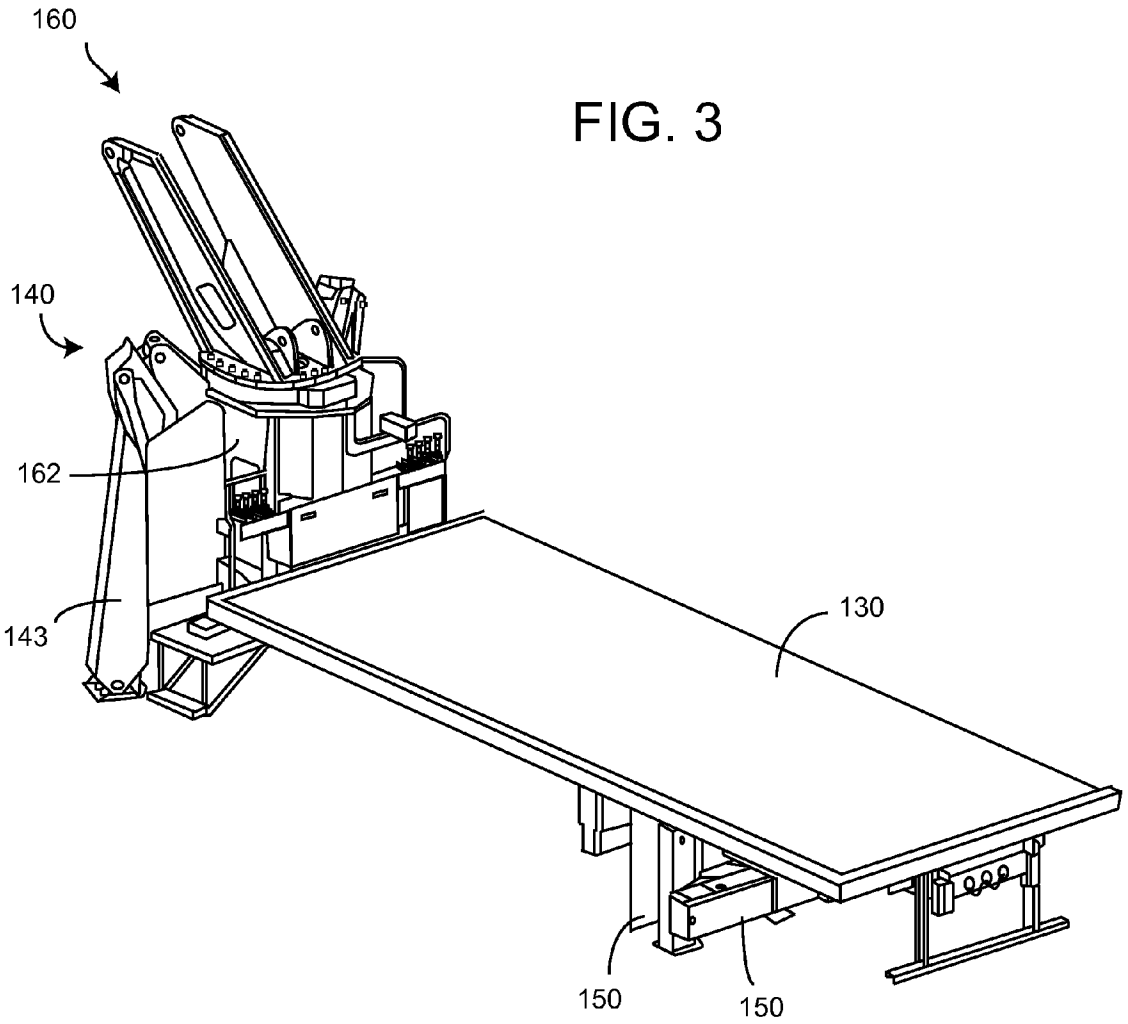
FIG. 3 shows a perspective view of portions of the splayed stabilized boom truck, including the connection between the turret elevating structure 160.

Now referring to FIG. 3, there is shown perspective view of portions of the present invention. The boom 120 is removed for increased visibility to otherwise at least partially-occluded portions of the present invention.

Now referring to FIG. 4, there is shown an elevation view of portions of the present invention to show the independence of the rear stabilizers 150 from the front stabilizers 140. It can be seen that there exist no structure, other than the frame of the vehicle, which both interconnects and provides support from below to both the splayed forward front stabilizer system 140 and the rear stabilizers 150. In FIG. 4, the forwardly disposed rear stabilizer shown the portion thereof which during deployment of the stabilizer will extend outwardly (out of the page) from the frame rails 132. Rear stabilizer 150 may also include a vertically adjustable leg and foot pad section that be extended downward from a horizontally extended stabilizer so as to contact the ground at a displaced position and thereby provide a lifting force to the frame rails 132 when desired. The rearwardly disposed stabilizer 150 shows the opposite end of the structure which could be extended into the page.

Figure 5:
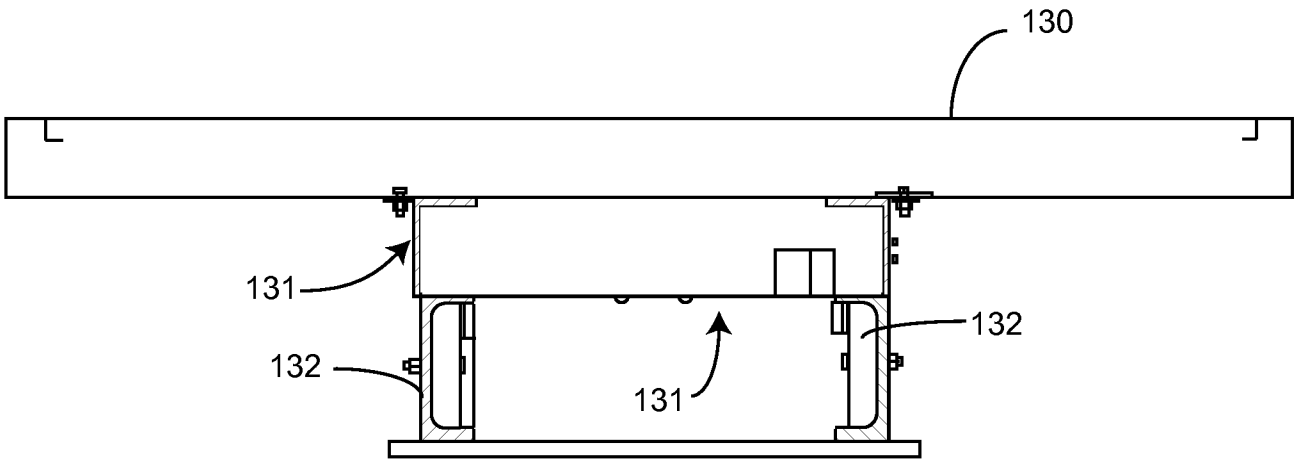
FIG. 5 shows a cross section view of the frame/sub-frame/cargo bed combination taken on line D-D of FIG. 4.

Now referring to FIG. 5, there is shown a cross-section view taken on line D-D of FIG. 4 which shows the combination of the frame 132, the sub-frame 131 and the cargo bed 130.

Throughout this discussion the terms "commercial truck chassis" have been used to mean a particular type of truck chassis. "Commercial truck chassis" is hereby defined herein to mean the following:

An operable highway ready truck which has been given a vehicle identification number, and includes a cab which is configured for use by a driver and at least one forward seated passenger seated adjacent to said driver, engine, drive train, and a frame and is manufactured and advertised for a variety of uses where non-boom truck applications exceed the boom truck uses, but specifically excludes any cranes which do not include any commercial load carrying capacity and a cargo section which is configured to carry objects which are not related to the operation or maintenance of the crane or vehicle.

The term "bifurcated K configuration" shall mean an operational configuration resembling the letter K where the vertical portion of the K is longitudinally separated or spaced apart from the two splayed portions, which remain together as a unit.

It is believed that when these teachings are combined with the known prior art by a person skilled in the art of boom truck design and equipment manufacture, many of the beneficial aspects and the precise approaches to achieve those benefits will become apparent.

It will be understood that certain features and sub-combinations are of utility and may be employed without reference to other features and sub-combinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

I claim:

1. A boom truck comprising:

a commercial truck chassis having a vehicle frame and a commercial cab;

a boom coupled to the commercial boom truck chassis;

a plurality of rear stabilizers coupled to the commercial boom truck chassis;

a plurality of substantially splayed forward front stabilizers coupled to said commercial boom truck chassis;

each of said rear stabilizers being free of an indirect load bearing connection with said vehicle frame, via a sub-frame which supports from below said plurality of splayed forward front stabilizers; and the combination of said plurality of splayed forward front stabilizers and said plurality of rear stabilizers being arranged in a non-X and a non-H configuration and instead arranged in a bifurcated K configuration.

2. The boom truck of claim 1 wherein said plurality of substantially splayed forward front stabilizers is splayed forward at a splay angle between 15 degrees and 45 degrees.

3. The boom truck of claim 2 wherein said splay angle is 27 degrees.

4. The boom truck of claim 1 where said plurality of rear stabilizers are non-co-linear and where one of said plurality of rear stabilizers is disposed proximal to said commercial cab and where a separation distance along said vehicle frame from said front stabilizers to said rear stabilizers is greater than a width of said boom truck when said plurality of splayed forward front stabilizers and said plurality of rear stabilizers are retracted.

5. The boom truck of claim 1 wherein said plurality of substantially splayed forward front stabilizers is splayed forward at a splay angle greater than 27 degrees and further comprising a door on said commercial cab which is configured to swing rearward when opening, to allow human ingress and egress.

6. The boom truck of claim 5 where said plurality of rear stabilizers are arranged in a parallel and substantially adjacent, but not co-linear configuration, where one of said plurality of rear stabilizers is disposed proximal to said commercial cab and said plurality of rear stabilizer is disposed substantially below a top cargo bed surface.

7. The boom truck of claim 6 where a separation distance along said vehicle frame from said front stabilizers to said rear stabilizers is greater than a width of said boom truck when said plurality of splayed forward front stabilizers and said plurality of rear stabilizers are not deployed.

8. A method of constructing a boom truck comprising the steps of:

obtaining a commercial truck chassis comprising a commercial truck frame;

providing a boom configured to be coupled to said commercial truck chassis;

providing a plurality of splayed forward front stabilizers; and providing a plurality of non-splayed rear stabilizers, wherein said plurality of non-splayed rear stabilizers are separate and distinct from said plurality of splayed forward front stabilizers such that no prior structural connection exist between any of said plurality of non-splayed rear stabilizers and any of said splayed forward front stabilizers, until and unless at least one of said plurality of splayed forward front stabilizers and at least one of said plurality of non-splayed rear stabilizers are coupled to said commercial truck chassis.

9. The method of claim 8 further comprising:

coupling said plurality of splayed forward front stabilizers to said commercial truck frame; and coupling at least one of said plurality of non-splayed rear stabilizers to said commercial truck frame.

10. The method of claim 9 wherein said step of coupling said plurality of splayed forward front stabilizers occurs before said step of coupling, at least one of said plurality of non-splayed rear stabilizers.

11. The method of claim 9 wherein said step of coupling said plurality of splayed forward front stabilizers occurs after said step of coupling at least one of said plurality of non-splayed rear stabilizers and said plurality of splayed forward front stabilizers and said plurality of rear splayed rear stabilizers are in a bifurcated K configuration.

12. The method of claim 11 wherein said bifurcated K configuration is a configuration that has the plurality of rear stabilizers disposed at a rear height below a front height above the ground of the plurality of front stabilizers.

13. A boom truck comprising:

a commercial truck chassis having a vehicle frame and a commercial cab;

a boom coupled to the commercial boom truck chassis;

a plurality of rear stabilizers coupled to the commercial boom truck chassis;

a plurality of substantially splayed forward front stabilizers coupled to said commercial boom truck chassis; and a cargo bed disposed immediately behind said plurality of front stabilizers.

14. The boom truck of claim 13 wherein said cargo bed extends to the rear terminal location of said boom truck.

15. The boom truck of claim 14 wherein the combination of said plurality of splayed forward front stabilizers and said plurality of rear stabilizers being arranged in a non-X and a non-H configuration and instead arranged in a bifurcated K configuration.

* * * * *